US006996857B2

(12) United States Patent
Fukasawa

(10) Patent No.: US 6,996,857 B2
(45) Date of Patent: Feb. 14, 2006

(54) SWIMMING GOGGLES

(75) Inventor: Shunji Fukasawa, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 10/732,414

(22) Filed: Dec. 11, 2003

(65) Prior Publication Data

US 2005/0125883 A1 Jun. 16, 2005

(51) Int. Cl.
*A61F 9/02* (2006.01)

(52) U.S. Cl. ..... 2/428

(58) Field of Classification Search ..... 2/428, 2/430, 440, 439, 426, 427, 429, 431, 432, 2/433, 434, 435, 436, 437, 438, 441, 442, 2/443, 444, 445, 446, 447, 448, 449, 450, 2/451, 452, 453; 351/43
See application file for complete search history.

(56) References Cited

U.S. PATENT DOCUMENTS 4,689,837 A * 9/1987 Bolle ..... 2/440
6,253,387 B1 * 7/2001 Yu ..... 2/428
6,272,693 B1 * 8/2001 Godoy ..... 2/430
6,321,390 B1 * 11/2001 Chiang ..... 2/428
6,460,196 B1 * 10/2002 Tsubooka et al. ..... 2/428
6,467,098 B1 * 10/2002 Lee ..... 2/443
6,604,247 B1 * 8/2003 Chiang ..... 2/428

FOREIGN PATENT DOCUMENTS

JP 11-33139 2/1999

* cited by examiner

*Primary Examiner*—John J. Calvert
*Assistant Examiner*—Brian Kauffman
(74) *Attorney, Agent, or Firm*—Lowe Hauptman & Berner, LLP

(57) ABSTRACT

Swimming goggles includes a pair of lens portions, a peripheral wall portion extending rearward from a periphery of each of the lens portions, a nose belt portion, and a strap. The peripheral wall portion includes an inner peripheral wall portion which comes in contact with a surrounding area of a wearer's eye, and an outer peripheral portion which is formed to surround at least a portion of the inner peripheral wall portion. The outer peripheral wall portion is extended from a portion of a surrounding area of an inner peripheral wall portion positioned on at least upper and lower sides of the lens portion toward a rear side thereof so as to be gradually moved apart from an outer surface of the inner peripheral wall portion.

10 Claims, 5 Drawing Sheets

SWIMMING GOGGLES

BACKGROUND OF THE INVENTION

This invention relates to swimming goggles.

There have been suggested various athletic swimming goggles contrived to reduce flow resistance, one of which is disclosed in Japanese Patent Application Publication No. 1999-33139A. In the swimming goggles, outer surfaces of front and rear peripheral wall portions which constitute a lens peripheral wall portion are smoothly connected together to reduce its resistance.

However, in the aforementioned well-known swimming goggles, an annular step is formed between a cushion portion which comes in contact with a wearer's face and a rear end surface of the rear peripheral wall portion to which the cushion portion is attached. As this step tends to cause a turbulent water flow, there is a problem that flow resistance is not necessarily reduced.

SUMMARY OF THE INVENTION

The present invention has been made to solve the foregoing conventional problem, and an object of the invention is to provide swimming goggles which can reduce flow resistance on a lens peripheral wall portion.

In order to achieve the object, the present invention is directed to swimming goggles which comprise: a pair of lens portions; a peripheral wall portion extending rearward from a periphery of each of the pair of lens portions; a nose belt portion for interconnecting inner end portions of the pair of lens portions; and a strap for interconnecting outer edge portions of the pair of lens portions.

The swimming goggles further comprises the peripheral wall portion comprising an inner peripheral wall portion whose rear end portion comes in contact with a surrounding area of a wearer's eye, and an outer peripheral portion which is located outside an inner peripheral wall portion and formed to surround at least a portion of the inner peripheral wall portion. The outer peripheral wall portion is extended from a portion of the inner peripheral wall portion positioned on at least upper and lower sides of the lens portion toward a rear side of the lens portion so as to be gradually spaced apart from an outer surface of the surrounding area of the inner peripheral wall portion.

The swimming goggles of the present invention includes the following embodiments.

The outer peripheral wall portion can be made gradually thinner toward a rear side thereof. At least a portion of a rear end portion of the outer peripheral wall portion may be positioned rearward of a rear end portion of the inner peripheral wall portion.

The rear end portion of the outer peripheral wall portion may be positioned forward of the rear end portion of the inner peripheral wall portion.

DETAILED DESCRIPTION OF THE PREFERRED EMBODIMENTS

Next, detailed description will be made of swimming goggles of the present invention with reference to the accompanying drawings.

Figure 1:
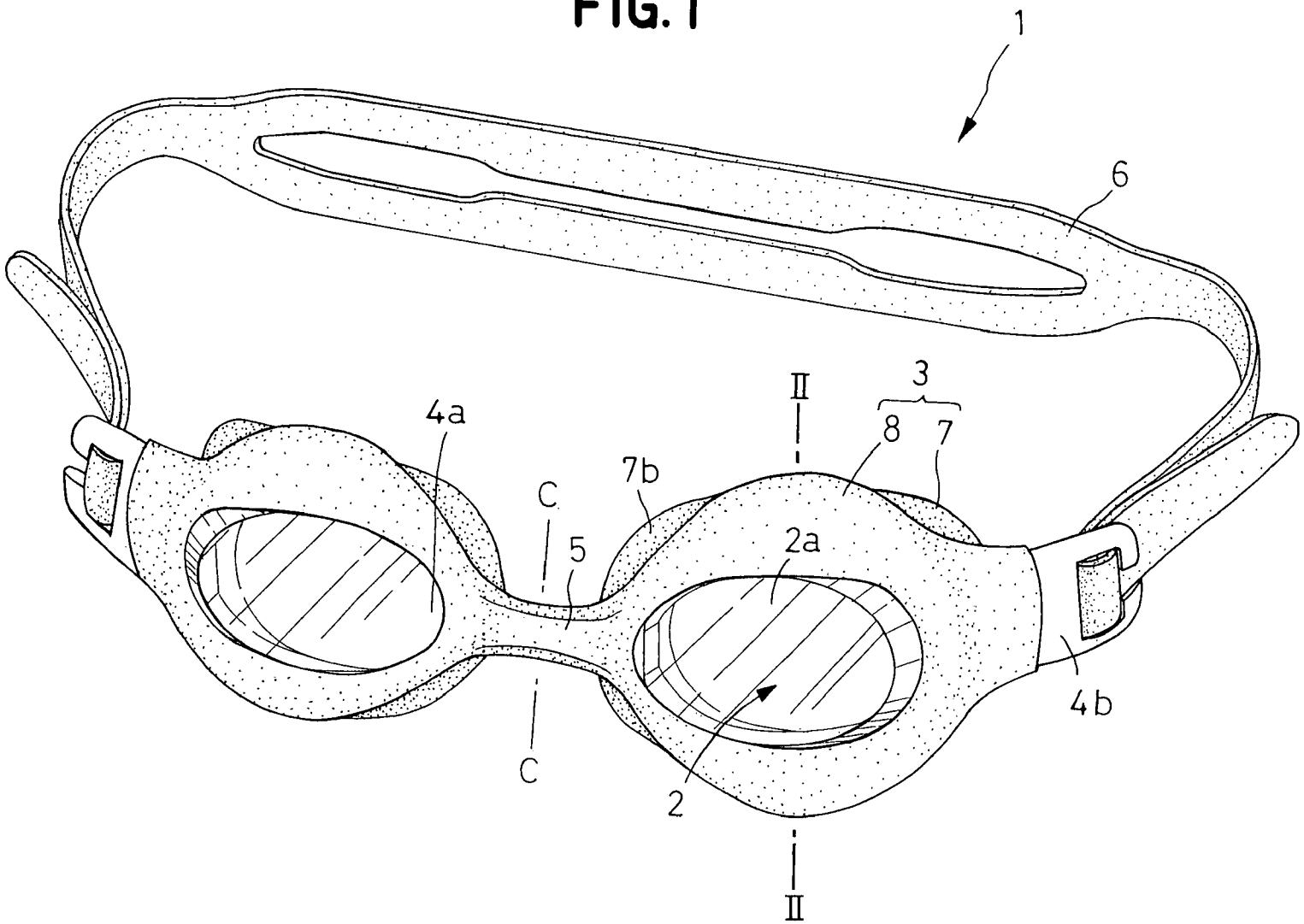
FIG. 1 is a perspective view of swimming goggles in accordance with an embodiment of the invention.

Swimming goggles 1 depicted in a perspective view of FIG. 1 comprise a pair of lens portions 2 made of hard materials and arrayed in a horizontal direction on a front side, and a peripheral wall portion 3 extending rearward from a periphery of each of the lens portions 2. Inner edge portions 4*a* of the lens portions 2 are interconnected by a nose belt portion 5 integral with the peripheral wall portion 3. However, the nose belt portion 5 may be formed so that both ends can be detachably attached to the inner edge portion 4*a* of each lens portion 2. An outer edge portion of the lens portion 2 constitutes a buckle portion 4*b* extending rearward, and a strap 6 is attached to the buckle portion 4*b* so as to be adjusted for length. The swimming goggles 1 are formed to be symmetrical at a center line C—C which divides the nose belt portion 5 into two equal lengths.

Figure 2:
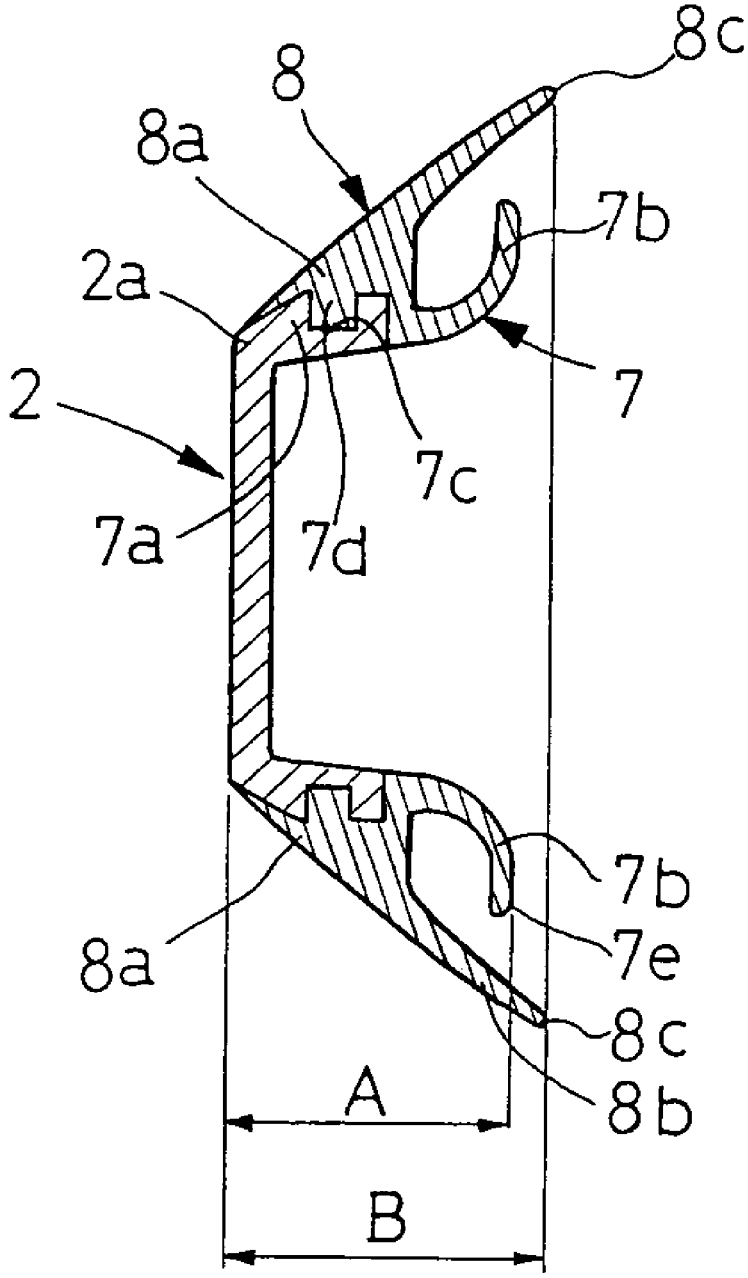
FIG. 2 is a sectional view cut along the line II—II of FIG. 1.

FIG. 2 is a sectional view cut along the line II—II of FIG. 1. This line II—II is parallel to the center line C—C, and travels down through the lens portion 2 at a position in which a size of a vertical direction becomes largest. The peripheral wall portion 3 comprises an annular inner wall peripheral portion 7 extending rearward from an entire peripheral edge 2*a* of the lens portion 2, and the inner wall peripheral portion 7 is composed of a front end portion 7*a* extending rearward from the periphery of each of the lens portion 2 and a rear end portion 7*b* which comes in contact with a surrounding area of a wearer's eye of the swimming goggles. The peripheral wall portion 3 further comprises an outer peripheral wall portion 8 extending rearward from the front end portion 7*a* of the inner peripheral wall portion 7 so as to surround the inner peripheral wall portion 7.

In the inner peripheral wall portion 7 of the shown example, the front end portion 7*a* is made of a hard plastic material to be integral with the lens portion 2, and the rear end portion 7*b* is made of a flexible elastic material to constitute a cushion pad. In the inner peripheral wall portion 7, a groove 7*c* for fitting is formed on an outer peripheral surface of the front end portion 7*a*, and a projection 7*d* formed on an inner peripheral surface of the outer peripheral wall portion 8 is fitted in the groove 7 detachably or undetachably. In the rear end portion 7*b* of the inner peripheral wall portion 7, a portion thereof which has come in contact with the wearer is gently bent toward the outside.

As apparent from FIG. 2, the outer peripheral wall portion 8 is formed integrally with and from the same material as the rear end portion 7*b* of the inner peripheral wall portion 7. A front end portion 8*a* of the outer peripheral wall portion 8 is closely mated with the front end portion 7*a* of the inner peripheral wall portion 7 from the outside. The outer peripheral wall portion 8 is widened outside so that the rear end portion 8*b* can be moved more apart from the inner peripheral wall portion 7 toward the rear side. Additionally, the rear end portion 8*b* is made gradually thinner toward the rear side. On the section cut along the line II—II, a size from a front of the lens portion 2 to a rear end 7*e* of the inner peripheral wall portion 7 is A, and a size to a rear end 8*c* of the outer peripheral wall portion 8 is B. The size B is larger than the size A, and the rear end 8*c* of the outer peripheral wall portion 8 is positioned rearward of the rear end 7*e* of the inner peripheral wall portion 7.

The outer peripheral wall portion 8 is formed on a portion of a surrounding zone of the inner peripheral wall portion 7 extending on the entire peripheral edge 2*a* of the lens portion 2 positioned on at least upper and lower sides of the lens portion 2. In the depicted example, however, the outer peripheral wall portion 8 is also formed on both portions near the inner end portion 4*a* of the lens portion 2 and near the buckle 4*b*, that is, the outer peripheral wall portion 8 is continuously formed along the entire peripheral edge 2*a* of the lens portions 2. In the swimming goggles 1 having such an outer peripheral wall portion 8, on the line II-II and in the vicinity thereof, a gentle and smooth slope is formed from the peripheral edge 2*a* of the lens portion 2 toward a wearer's face outside the inner peripheral wall portion 7.

Figure 3:
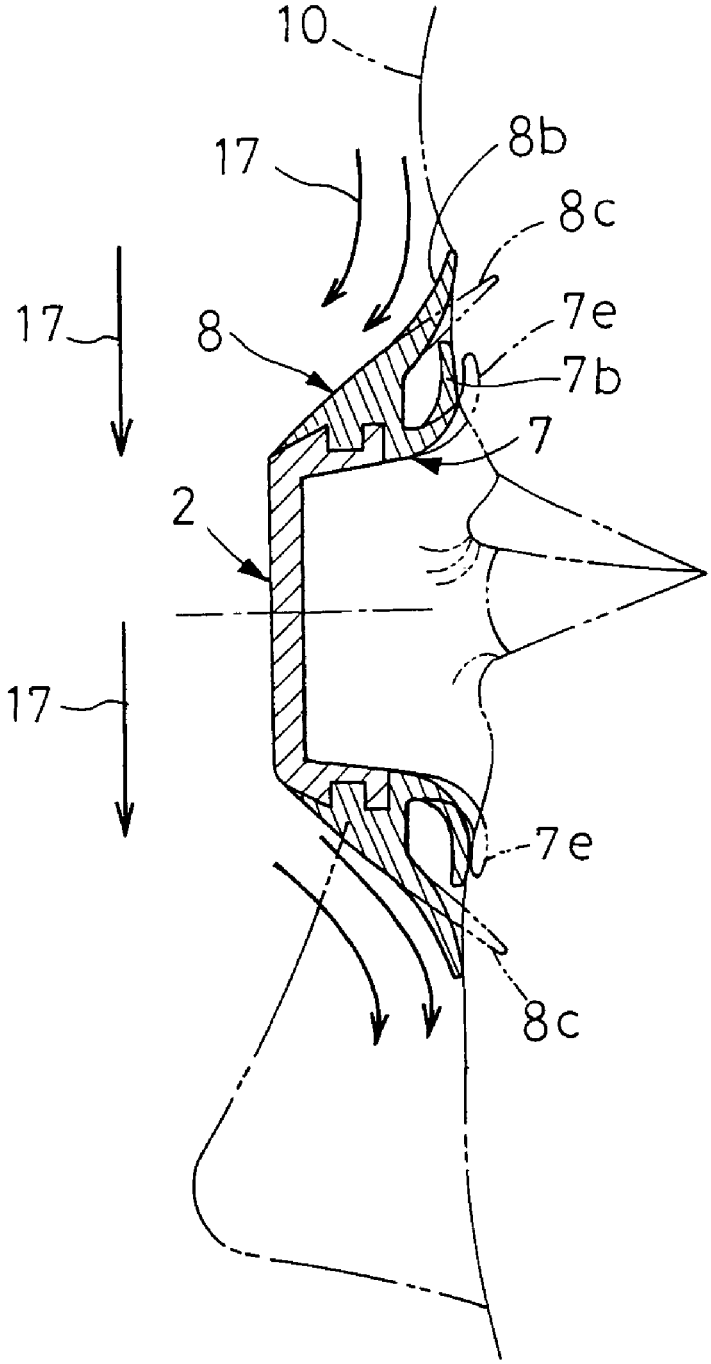
FIG. 3 is a view similar to FIG. 2 showing the goggles in use.

FIG. 3 is a view similar to FIG. 2 depicting a state in which the swimming goggles 1 thus formed are put on. When the swimming goggles 1 are put on, the rear end portion 7*b* of the inner peripheral wall portion 7 comes in close contact with the surrounding area of a wearer's eye. At this time, the rear end portion 8*b* of the outer peripheral portion 8 also comes close to or gently contacts a wearer's face 10. Since the outer peripheral wall portion 8 is connected from the lens portion 2 to the face 10 by the gentle and smooth slope outside the inner peripheral wall portion 7, water smoothly flows, e.g., in an arrow direction 17 during swimming. In the case of swimming goggles which have no outer peripheral wall portion 8, no smooth slope is formed between the peripheral wall portion 3 and the face 10. Thus, a flow of water on the peripheral wall portion tends to become turbulent to increase water resistance.

Figure 4:
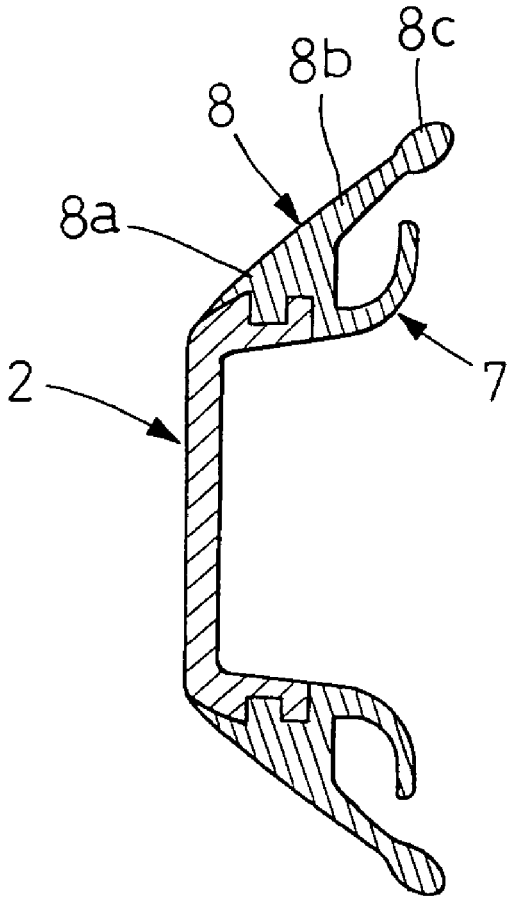
FIG. 4 is a view similar to FIG. 2 showing another embodiment of the present invention.

FIG. 4 is also a view similar to FIG. 2 depicting an embodiment of the present invention. An outer peripheral wall portion 8 of swimming goggles 1 is formed in such a manner that a rear end portion 8*b* is made gradually thinner toward a rear side, and made thick again in the vicinity of a rear end 8*c*. In the outer peripheral wall portion 8 formed in this manner, rigidity of the rear end portion 8*b* is increased compared with the example of FIG. 2, and turning-over in a direction apart from a wearer's face may be prevented.

Figure 5:
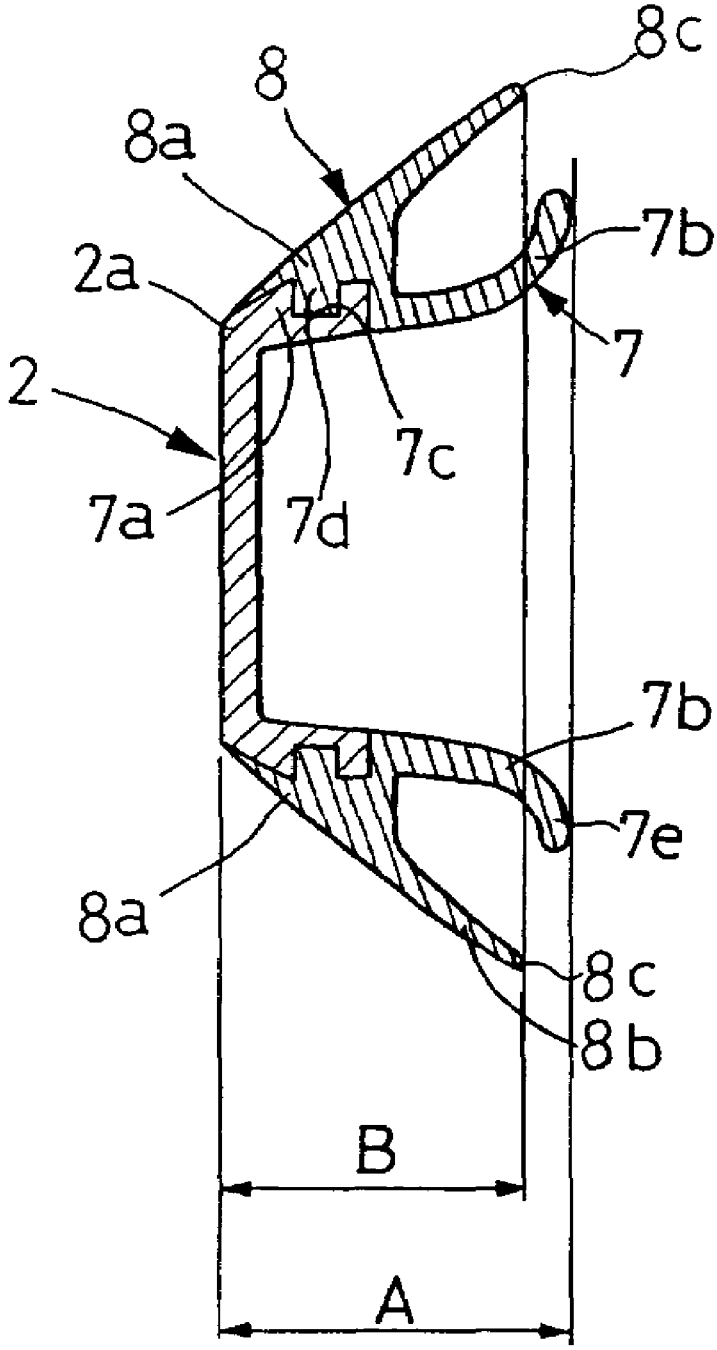
FIG. 5 is a view similar to FIG. 2 showing a further embodiment of the invention.

According to the present invention, the annular outer peripheral wall portion 8 of the depicted example may be formed so as to be positioned only at portions, upper and lower sides of the lens portion 2. The outer peripheral wall portion 8 is integrally made of the flexible elastic material similar to that of the rear end portion 7*b* of the inner peripheral wall portion 7. Besides, it may be made of a hard material similar to that of the lens portion 2. In the outer peripheral wall portion 8 of this case, the rear end 8*c* is preferably positioned forward of the rear end 7*e* of the inner peripheral wall portion 7 as shown in FIG. 5. For the outer peripheral wall portion 8, only the rear end portion 8*b* may be made of a flexible elastic material, or it may be formed separately from the inner peripheral wall portion 7 to be attached to the outer surface of the inner peripheral wall portion 7 by well-known customary joining means. In addition to smooth formation of the outer surface of the outer peripheral wall portion 8, a number of dimple-shaped concave portions may be formed to enable a smooth water flow on the outer surface. For the inner peripheral wall portion 7, the rear end portion 7*b* made of the flexible elastic material can be made of a hard material integrally with the front end portion 7*a*.

According to the swimming goggles of the present invention, since there is a connection from the lens portion to the vicinity of the wearer's face of the goggles by the gentle slope, a turbulent water flow which easily occurs in the vicinity of the goggles during swimming can be prevented to reduce water resistance.

What is claimed is:

1. Swimming goggles, comprising:

a pair of lens portions;

a nose belt connecting inner portions of said lens portions; and a strap connecting outer portions of said lens portions;

wherein each of said lens portions comprises:

a lens comprising a front surface which defines the forwardmost part of said lens portion and an opposite, rear surface which is adapted to face a wearer's eye in use; and a peripheral wall comprising a connecting portion being attached to said lens, and inner and outer wall portions extending rearwardly from said connecting portion;

wherein said inner wall portion has a rear end which is adapted to come into contact with the wearer's face, is entirely positioned forward of a rearmost end of said outer wall portion, and extends radially outwardly towards the outer wall portion.

2. The swimming goggles according to claim 1, wherein the rearmost end of said outer wall portion is an enlarged portion; and said outer wall portion further has a section positioned forward of and contiguous to said enlarged portion, said section having a thickness that gradually decreases toward said enlarged portion.

3. The swimming goggles according to claim 1, wherein each of said lens portions consisting of first and second bodies made of first and second materials and attached to each other, the first body being defined by said lens, said connecting portion and said inner and outer wall portions being integrated into the second body.

4. The swimming goggles according to claim 1, wherein said peripheral wall has an outer surface defined by said connecting portion and said outer wall portion, and said rearmost end of said outer wall portion is adapted to come into contact with the wearer's face;

said outer surface of said peripheral wall extending exclusively rearwardly, continuously from the front surface of said lens to the rearmost end of said outer wall portion and defines a smooth slope which extends rearwardly, continuously from the front surface of said lens to the wearer's face in use, thereby reducing water turbulence during swimming.

5. The swimming goggles according to claim 1, wherein said lens includes a central portion having said front and rear surfaces and a peripheral portion which extends rearwardly from said central portion and is attached to the respective connecting portion.

6. The swimming goggles according to claim 5, wherein the peripheral portion of said lens and the respective connecting portion have matching projections and grooves which interlock said lens to said respective connecting portion, and the projections and grooves are positioned rearward of the rear surface of the central portion of said lens.

7. Swimming goggles, comprising:

a pair of lens portions each comprising a lens having a front surface adapted to come into contact with water in use and an opposite, rear surface adapted to face a wearer's eye in use; and a peripheral wall portion extending rearwardly from said lens;

a nose belt portion interconnecting inner end portions of said lens portions; and a strap interconnecting outer end portions of said lens portions;

wherein said peripheral wall portion comprises:

an inner peripheral wall portion having a rear end adapted to come in contact with a surrounding area of the wearer's eye, and an outer peripheral wall portion which is located outside said inner peripheral wall portion and surrounds said inner peripheral wall portion;

wherein each of said lens portions has an outer surface which is adapted to come into contact with water in use and is defined at least by the front surface of the respective lens and an outer surface of said peripheral wall portion, wherein said outer surface of each of said lens portions extends exclusively rearwardly, continuously from the front surface of the respective lens to a rear end of said outer peripheral wall portion to define a slope which extends rearwardly, continuously towards the wearer's face in use, thereby reducing water turbulence during swimming; and wherein the rear end of said inner peripheral wall portion is entirely positioned forward of a rearmost end of said outer peripheral wall portion, and extends radially outwardly towards the outer peripheral wall portion.

8. The swimming goggles according to claim 7, wherein each of said lens portions consisting of first and second bodies made of first and second materials and attached to each other, the first body being defined by said lens, and the second body being defined by said peripheral wall portion.

9. The swimming goggles according to claim 7, wherein the rear end of said outer peripheral wall portion is an enlarged rear end; and said outer peripheral wall portion further has a section positioned forward of and contiguous to said enlarged rear end, said section having a thickness that gradually decreases toward said enlarged rear end.

10. The swimming goggles according to claim 9, wherein said enlarged rear end is positioned rearward of the rear end of said inner peripheral wall portion.

* * * * *